US006601964B2

(12) United States Patent
Wang et al.

(10) Patent No.: US 6,601,964 B2
(45) Date of Patent: Aug. 5, 2003

(54) LAMP HAVING A READABLE DISK WITH AN ELECTRO-LUMINESCENT ELEMENT

(75) Inventors: Shaw-Jong Wang, Hsinchu (TW); Joseph Shen, Taipei (TW); Chien-Hua Wu, Miao Li Hsien (TW); Charen Yu, Taipei (TW)

(73) Assignee: Ritek Corporation, Taiwan (TW)

( * ) Notice: Subject to any disclaimer, the term of this patent is extended or adjusted under 35 U.S.C. 154(b) by 0 days.

(21) Appl. No.: 09/805,033

(22) Filed: Mar. 14, 2001

(65) Prior Publication Data

US 2002/0067606 A1 Jun. 6, 2002

(30) Foreign Application Priority Data

Dec. 6, 2000 (TW) ..... 89221188 U

(51) Int. Cl.[7] ..... F21V 9/16
(52) U.S. Cl. ..... 362/84; 362/34; 368/67
(58) Field of Search ..... 362/34, 84, 806; 368/67

(56) References Cited

U.S. PATENT DOCUMENTS

| | | | | | |
|---|---|---|---|---|---|
| 2,908,806 | A | * | 10/1959 | Cohen | 313/510 |
| 3,056,897 | A | * | 10/1962 | Knochel et al. | 313/324 |
| 3,651,319 | A | * | 3/1972 | Norris et al. | 362/232 |
| 3,694,645 | A | * | 9/1972 | Brantz | 362/811 |
| 3,992,874 | A | * | 11/1976 | Collins | 362/23 |
| 4,017,155 | A | * | 4/1977 | Yagi et al. | 349/113 |
| 4,161,018 | A | * | 7/1979 | Briggs et al. | 362/104 |
| 4,214,296 | A | * | 7/1980 | Magett | 362/147 |
| 4,343,032 | A | * | 8/1982 | Schwartz | 362/147 |
| 4,823,240 | A | * | 4/1989 | Shenker | 362/103 |
| 5,128,595 | A | * | 7/1992 | Hara | 307/11 |
| 5,337,224 | A | * | 8/1994 | Field et al. | 313/509 |
| 5,381,310 | A | * | 1/1995 | Brotz | 362/556 |
| 5,515,247 | A | * | 5/1996 | Cheung et al. | 362/103 |
| 5,608,715 | A | | 3/1997 | Yokogawa | 369/275.1 |
| 5,618,100 | A | * | 4/1997 | Glynn | 136/211 |
| 5,638,339 | A | * | 6/1997 | DeLoretto et al. | 362/226 |
| 5,749,646 | A | * | 5/1998 | Brittell | 362/231 |
| 5,816,682 | A | * | 10/1998 | Marischen | 362/276 |
| 5,926,440 | A | * | 7/1999 | Chien | 362/226 |
| 6,065,848 | A | * | 5/2000 | Tucker et al. | 362/101 |
| 6,106,135 | A | * | 8/2000 | Zingale et al. | 362/186 |
| 6,158,868 | A | * | 12/2000 | Chien | 362/253 |
| 6,160,346 | A | | 12/2000 | Vlegger | 313/512 |
| 6,170,958 | B1 | * | 1/2001 | Chien | 362/84 |
| 6,250,773 | B1 | * | 6/2001 | Lai | 362/226 |
| 6,302,559 | B1 | * | 10/2001 | Warren | 362/226 |

FOREIGN PATENT DOCUMENTS

| | | |
|---|---|---|
| CN | 089214554 | 8/2000 |

OTHER PUBLICATIONS

Wang, S.J. et al., "Luminous Disk", Ser. No. 09/399,326, filed on Sep. 20, 1999.

* cited by examiner

*Primary Examiner*—Sandra O'Shea
*Assistant Examiner*—Ismael Negron
(74) *Attorney, Agent, or Firm*—Finnegan, Henderson, Farabow, Garrett & Dunner, L.L.P.

(57) ABSTRACT

A lamp comprising a readable disk and a socket. The readable disk includes a readable surface for retrieving recorded data and a light-emitting surface provided with a plurality of conductive terminals. The socket includes a body having a lengthwise slot for receiving a readable disk, a plug and a plurality of solder bumps placed in the slot to be electrically connected with a plug. When the readable disk is inserted into the slot, the plurality of conductive terminals and solder bumps are conducted to excite the readable disk to luminescent.

19 Claims, 7 Drawing Sheets

LAMP HAVING A READABLE DISK WITH AN ELECTRO-LUMINESCENT ELEMENT

BACKGROUND OF THE INVENTION

1. Field of the Invention

The present invention relates to a lamp, and particularly to a lamp utilizing a readable disk with an electro-luminescent element to illuminate.

2. Description of Related Art

Compact disks have been extensively used as a medium for recording video, audio and digital data. Usually, a readable surface containing data read by a laser is on one side of the compact disk, and a transparent protective layer is used to cover the readable surface. In addition, a lot of patterns are printed on the other side of the compact disk for marking the content of the compact disk and enriching the vision feeling of the compact disk. As the medium and advertisement progress, a purely planar printing cannot draw an attraction by people gradually and lose its appreciation purpose. U.S. application Ser. No. 09/399,326 by one primary inventor of the present invention, entitled "Disk with Light Emitting," disclosed a readable disk containing a compact disk portion and an electro luminescent (EL) portion. The compact disk portion includes a substrate on which digital data is recorded. The EL portion can luminesce by applying external electricity. The compact disk can be a CD-ROM, CD-R, CD-RW, DVD-ROM, DVD-R, DVD-RW and MD, etc., and has a hole for being fixed and rotated by a disk carrier.

Because the readable disk utilizes prior manufacturing processes and increases a special lighting function, people will be more interested in collecting these kinds of products. In addition, the readable disk can be designed to emit light partially, intermittently, and with various colors.

Besides, since a nightlight can emit a small amount of light in dark as a temporary guide, and it has been extensively used in corridors and small rooms. Prior nightlights mostly used an incandescent lamp as a light source. As an EL lamp is developed, few products used the EL lamp as a nightlight. The EL lamp has advantages of long life, little power consumption and safety. ROC application No. 89214554, entitled "Ultra-Thin Nightlight," disclosed an ultra-thin nightlight having a simple structure and utilizing an EL lamp as a light source.

Since the prior art readable disk does not disclose a carrier, the function of fixing and guidance in dark cannot be developed. Besides, the above nightlight is a purely illuminating device, and lacks the function of reserving CD. Therefore, how to combine a readable disk and a nightlight into a device for collecting CD more easily, creating a second function of compact disks and owning beauty of sense and illumination in dark is an important issue.

SUMMARY OF THE INVENTION

A first object of the present invention is to propose a lamp utilizing a readable disk, which not only has the same function with prior art nightlight, but also makes a convenience for users to collect and store readable disks.

A second object of the present invention is to increase functions of nightlights through developments of the readable disk emits light from a part of the disk, an intermittent light, or lights of different colors. The readable disk and the nightlight are combined into a special design (such as a clock design) for inducing customers' interest and purchasing desire.

For achieving the above objects, the present invention proposes a lamp for use with a readable disk. The present invention comprises a readable disk and a socket. The readable disk includes a readable surface and a light-emitting surface provided with a plurality of conductive terminals. The socket includes a body having a lengthwise slot for receiving the readable disk, a plug and a plurality of solder bumps placed in the slot for electrically connecting the plug. When the readable disk is inserted into the slot, the plurality of conductive terminals and solder bumps are conducted to excite the light-emitting disk to luminescent.

BRIEF DESCRIPTION OF THE DRAWINGS

The present invention will be described according to the appended

FIG. 3(*b*) is a cross-sectional view taken along line 1—1 of FIG. 2(*b*);

FIG. 3(*c*) is a cross-sectional view taken along line 2—2 of FIG. 2(*e*);

PREFERRED EMBODIMENT OF THE PRESENT INVENTION

Figure 1A:
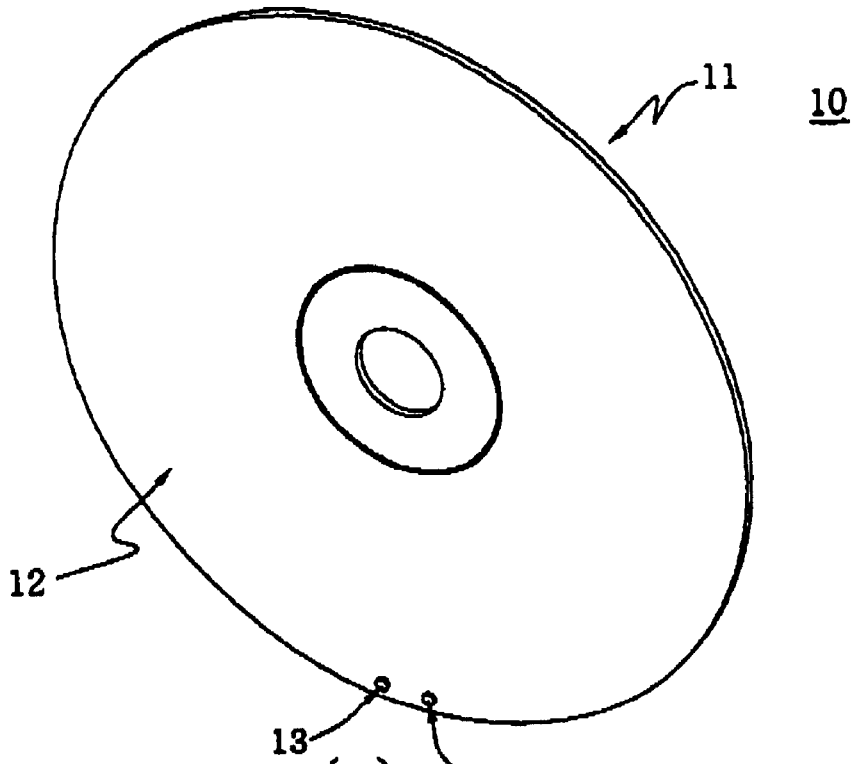
FIGS. 1(*a*) and (*b*) show readable disks according to embodiments of the present invention.
Figure 1B:
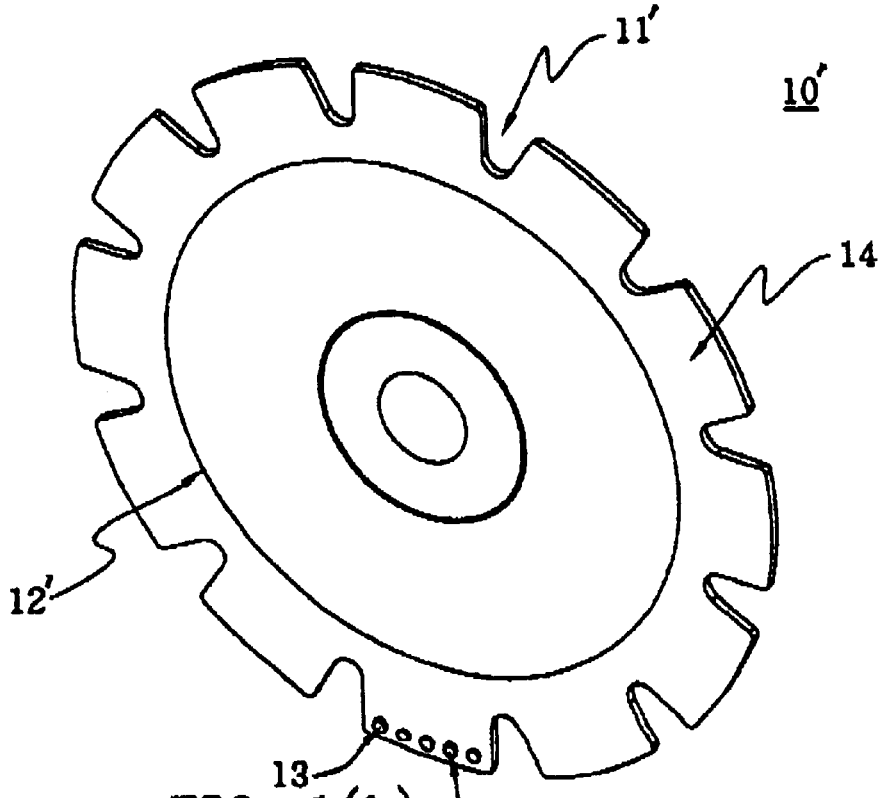

FIGS. 1(*a*) and (*b*) show readable disks according to embodiments of the present invention. The readable disk disclosed in the U.S. patent application Ser. No. 09/399,326 mentioned above is only an embodiment invented by the inventor. The present invention does not limit the process or structure of the readable disk, and all the readable disks whose one side (readable surface) is used to record data and another side (light-emitting surface) is used for illumination by applying external electricity are suitable to the present invention. Besides, the readable surface of the readable disk still has the recording function, such as prior CD-ROM, CD-R, CD-RW, DVD-ROM, DVD-R, DVD-RW and MD, etc., and the readable [light-emitting] disk still has various shapes, such as a shape of heart and ellipse or other irregular shapes. The readable disk can emit light partially, intermittently, and with various colors. The shape of the readable disk in FIG. 1(*a*) is circle, and two conductive terminals 13 are placed on the light-emitting surface 12. When external electricity is applied to these two conductive terminals, the light-emitting surface 12 will be excited to luminesce. The readable disk in FIG. 1(*b*) has a rim having a plurality of protruded regions 14, and a plurality of conductive terminals 13 are placed on the light-emitting surface 12. One of the conductive terminals can serve as a voltage reference point, and other conductive terminals are used to turn on or turn off illumination of corresponding protruded regions. External electricity can be applied to the plurality of conductive terminals and voltage reference point for lighting the readable disk partially, intermittently or with various colors.

Figures 2A, 2B, 2C, 2D, 2E, 2F:
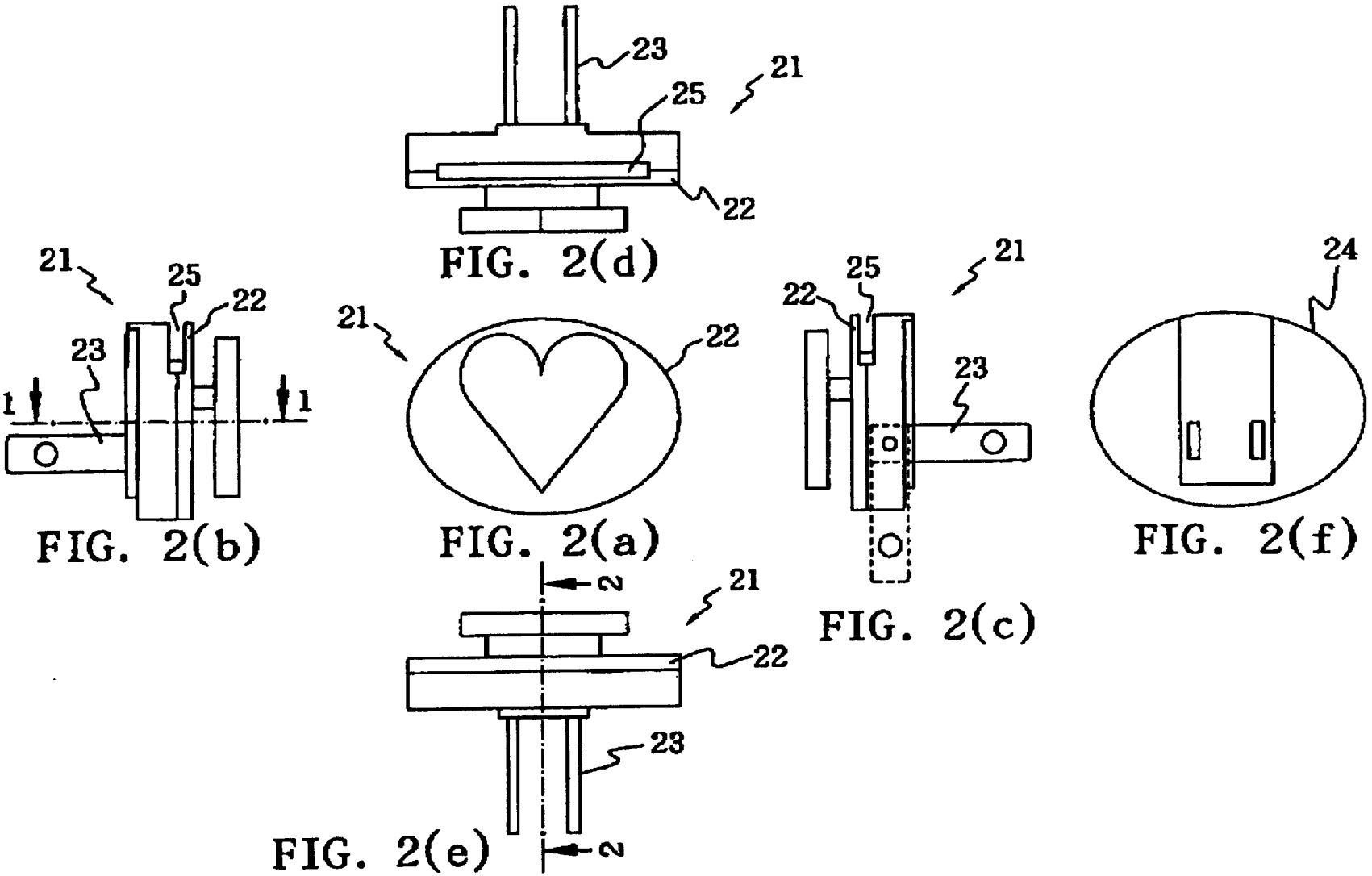
FIGS. 2(*a*)–2(*f*) are different views of a socket according to first embodiment of the present invention.

FIGS. 2(*a*)–2(*f*) show front, left side, right side, top and bottom views of a socket 21 according to the present invention. The socket 21 comprises a body 22 and a plug 23 coupled to the body 22. The plug 23 can rotate around both sides of the body along an axis on the pivot of the body 22 and plug 23, and it is convenient for users to insert the plug into an indoor socket 24 (as FIG. 2(*f*) shown) on the wall or on an extension cord in alterable angle. Besides, a lengthwise slot is disposed on the top surface of the body 22 to insert the readable disk therein.

Figure 3A:
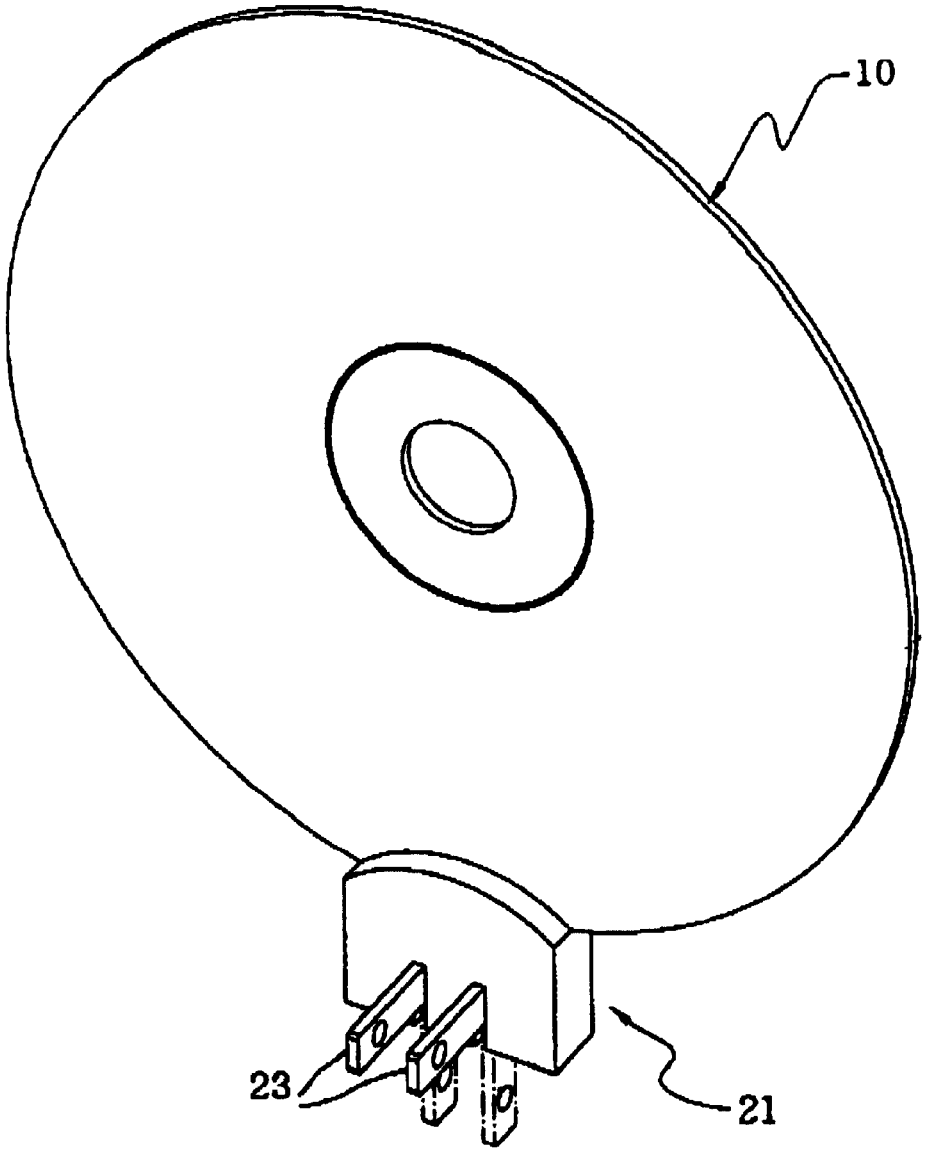
FIG. 3(*a*) shows a combination of a socket and a light-emitting disk according to a first embodiment of the present invention.
Figure 3B:
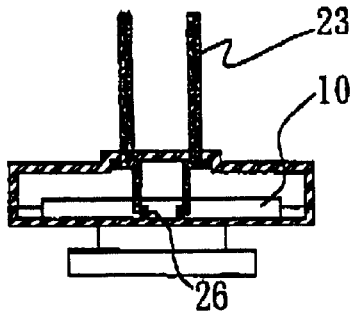
Figure 3C:
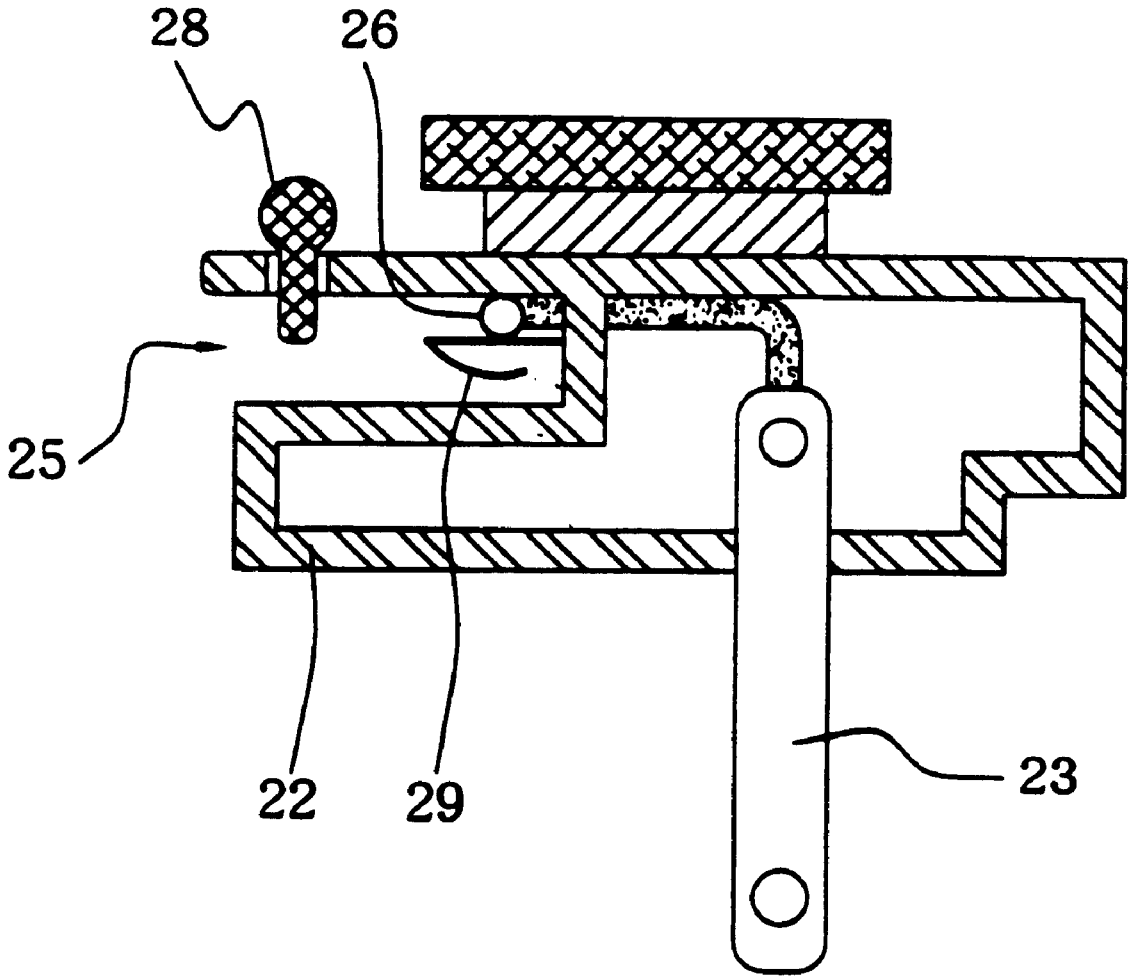

FIG. 3(*a*) shows a combination of a socket and a readable disk of a first embodiment of the present invention. First, a user can rotate those two conductive terminals of the readable disk 10 to an upright position, to and then vertically insert the readable disk 10 into the slot 25 of the body 22. FIG. 3(*b*) shows a cross-sectional view taken along line 1—1 of FIG. 2(*b*). The most important issue in combination of the disk and socket is whether these two conductive terminals contact well with solder bumps 26 on the disk. The contact is more close due topressing forces from elastic means such as a spring leaf 29 (as FIG. 3(*c*) shown) respectively joined to each of the solder bumps 26 as to ensure each of the conductive terminals 13 and corresponding one of the solder bumps 26 being in a good electrical connection. The solder bumps 26 are directly or indirectly electrically connected to the plug 23, so that the light-emitting disk will obtain external electricity through the indoor socket to luminesce. A dovetail 28 (as FIG. 3(*c*) shown) is designed inside the socket 21 for helping the users to align the two conductive terminals 13 with the solder bump 26 easily. Of course, after inserting the readable disk 10 into the socket 21, users can clockwise or counterclockwise rotate the readable disk 10 until the disk is located at the right position for illumination.

Figure 4A:
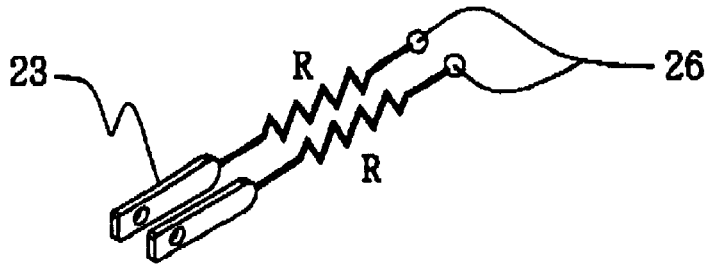
FIGS. 4(*a*) and (*b*) are schematic diagrams of the internal structure of the socket according to the present invention.
Figure 4B:
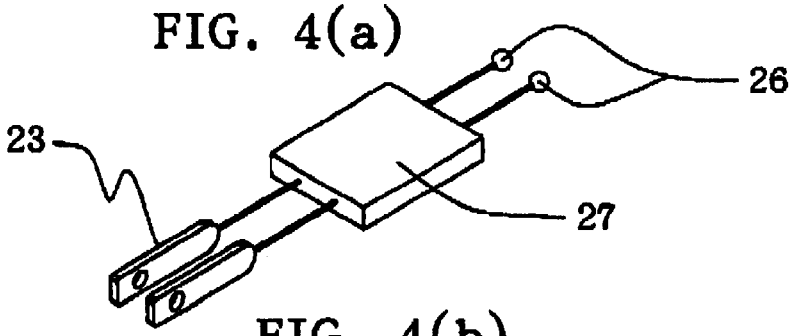

FIGS. 4(*a*) and (*b*) are schematic diagrams of the internal structure of the socket according to the present invention. The socket of the present invention is suitable for a typical indoor power of 110V~120V and 550 Hz~60 Hz or 220V~240V and 90 Hz~150 Hz. The present invention can further comprises resistors or capacitors, such as shown in FIG. 4(*a*), for use with the European specification of 220V~240V and 50 Hz–60 Hz. As shown in FIG. 4(*b*), an inverter 27 is used with the plug of the present invention in order to be suitable for electricity of 60V~150V and 50 Hz~2 KHz.

Figure 5:
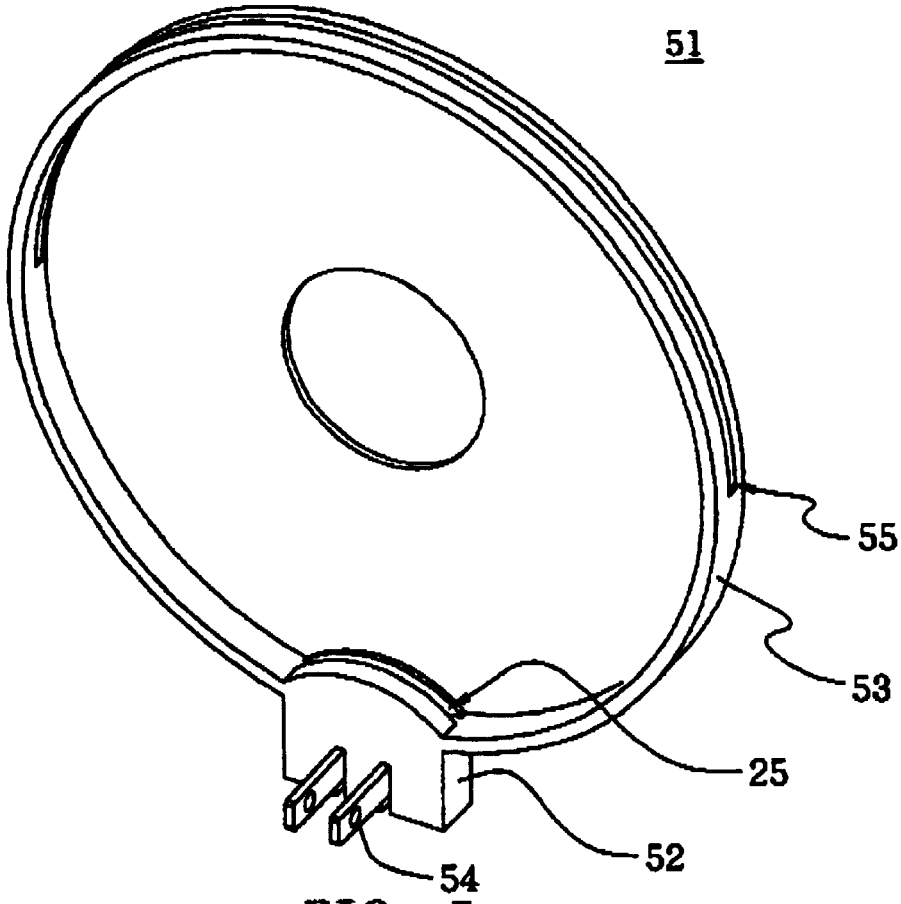
FIG. 5 shows a socket according to a second embodiment of the present invention.

FIG. 5 shows a socket 51 according to a second embodiment of the present invention. The socket 51 comprises a body 52, a mask 53 and a plug 54. The structures and functions of the body 52 and plug 54 are almost the same with those in the first embodiment, and the most difference is that this embodiment comprises a mask 53 for the body 52. The mask 53 is made of a transparent material for preventing the readable disk from being polluted by dust and humidity. Besides, a special material can be selected to soften the emitting light. The body 52 and mask 53 can be integrated into a single piece or assembled together and the present invention does not limit it. Furthermore, a lengthwise slot 55 on the top surface of the mask 53 is used to hold the readable disk 10, and the mask 53 has a circular hole whose diameter is larger than the circular hole of the readable disk 10.

Figure 6:
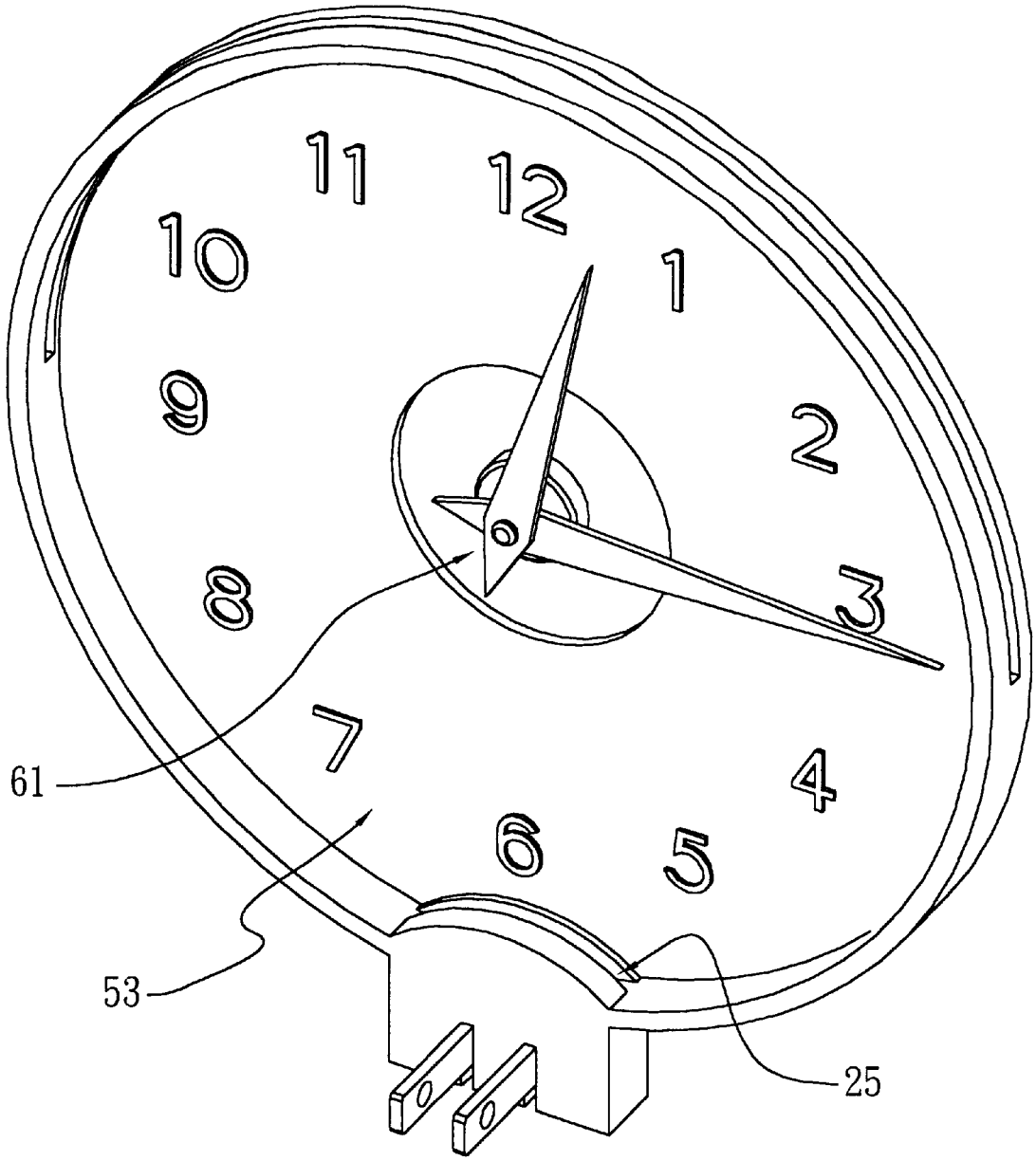
FIG. 6 shows a socket according to a third embodiment of the present invention.
Figure 7:
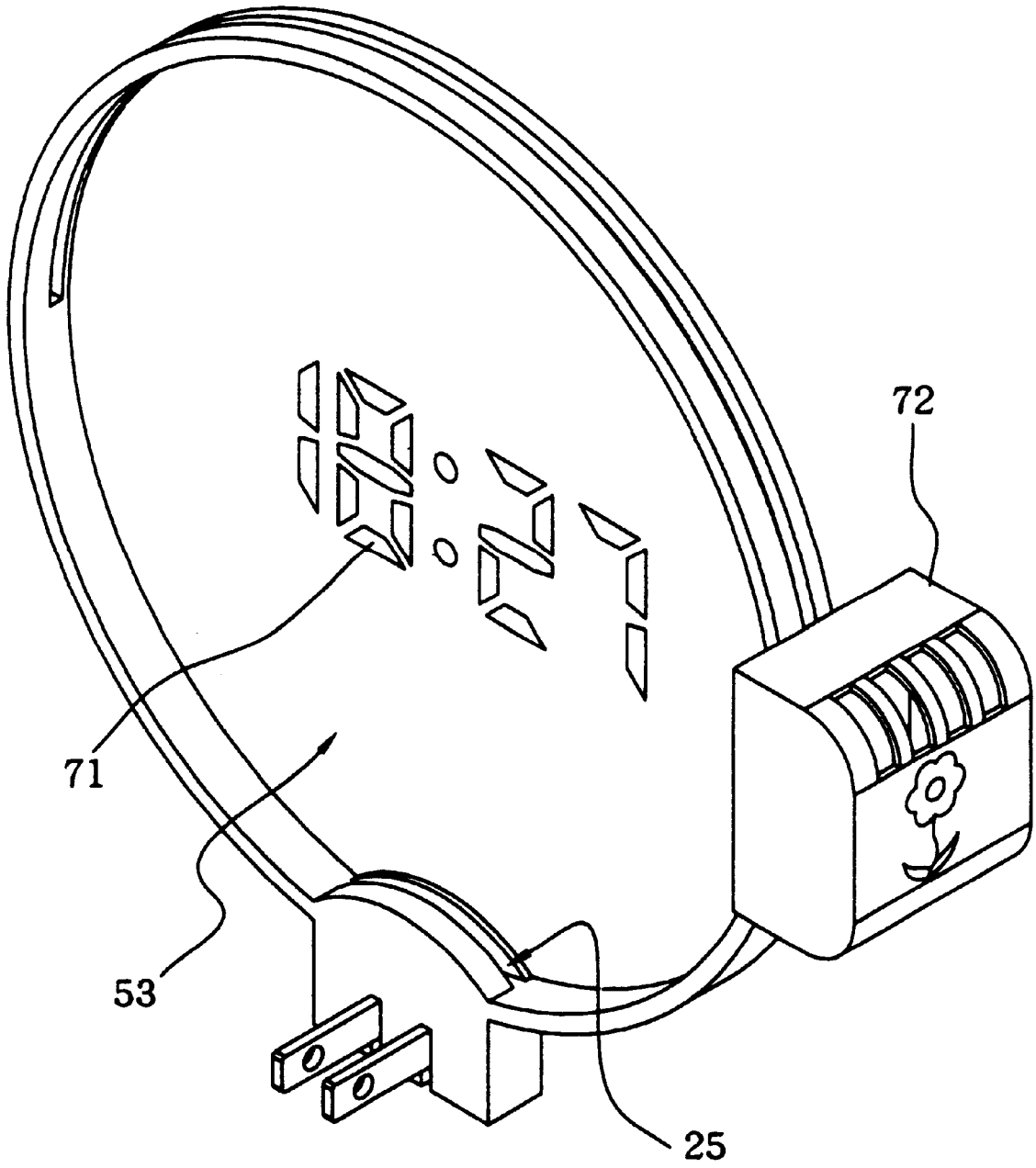
FIG. 7 shows a socket according to a fourth embodiment of the present invention.

FIG. 6 shows a socket according to a third embodiment of the present invention. In this embodiment, the mask 53 is shaped as a clock. A control box including an oscillator and control circuit (not shown) of the clock could be fixed or assembled on a first side of the mask 53. After inserting the readable disk, a user can extend a shaft 61 through the circular hole to the reverse side of the disk to control the movement of an hour hand and minute hand of a driving mechanism disposed inside the control box. By the above arrangement, the dimmer light utilized with the readable disk of the present invention can increase one function to act as a clock. In addition, the function as a clock can be improved by adding a LCD panel 71 (as FIG. 7 shown) instead of the original hour hand and minute hand. Furthermore, a perfume bottle 72 can be placed on the surfaces of the mask for eliminating the odor. A photo-switch (not shown) can be placed inside the body to act as a power switch which cuts off circuit in daytime to save energy.

The above-described embodiments of the present invention are intended to be illustrative only. Numerous alternative embodiments may be devised by those skilled in the art without departing from the scope of the following claims.

What is claimed is:

1. A lamp having a readable disk with an electro luminescent element, comprising:

a readable disk including a readable surface for retrieving recorded data in the readable disk and a light-emitting surface with an electro-luminescent element provided with a plurality of conductive terminals; and a socket including:

a body having a lengthwise slot for receiving the readable disk;

a plug being rotatable around both sides of the body along an axis of a pivot of the body and the plug; and a plurality of solder bumps placed in the slot and electrically connected with the plug;

wherein when the readable disk is inserted into the slot, the plurality of conductive terminals and solder bumps are conducted to excite the readable disk to luminesce.

2. The lamp of claim 1, further comprising elastic means joined to each of the solder bumps for performing a good electrical connection with the conductive terminals.

3. The lamp of claim 1, wherein said readable disk lights partially, intermittently, or with different colors by applying external electricity to the plurality of conductive terminals.

4. The lamp of claim 1, wherein the plurality of solder bumps are electrically connected to the plug via resistors or capacitors.

5. The lamp of claim 1, wherein the plurality of solder bumps are electrically connected to the plug via an inverter.

6. The lamp of claim 1, further comprising a dovetail inside the socket for facilitating aligning the plurality of conductive terminals with the solder bumps.

7. The lamp of claim 1, further comprising a transparent mask covering the body, and a slot located on the top surface of the mask for receiving the readable disk.

8. The lamp of claim 7, wherein said mask and body are integrated into one single piece.

9. The lamp of claim 7, further comprising a clock control box having a driving mechanism placed on a first surface of the mask, a clock made on a second surface of the mask, a shaft extending through the disk to be engaged with the driving mechanism, wherein the clock has a hour hand and minute hand engaged with one end of the shaft.

10. The lamp of claim 7, further comprising a perfume box placed on the surfaces of the mask.

11. A socket for the use of a readable disk, having a plurality of conductive terminals placed on a light-emitting surface of the readable disk, comprising:

a body having a lengthwise slot at its top surface for receiving the readable disk, and a plurality of solder bumps placed in the slot; and a plug coupled to the body and electrically connected to the plurality of solder bumps in the body, the plug being rotatable around both sides of the body along an axis of a pivot of the body and the plug;

wherein when the readable disk is inserted into the slot, the plurality of conductive terminals and solder bumps are conducted to excite the readable disk to luminesce.

12. The socket of claim 11, wherein the plurality of solder bumps are electrically connected to the plug via resistors or capacitors.

13. The socket of claim 11, wherein the plurality of solder bumps are electrically connected to the plug via an inverter.

14. The socket of claim 11, further comprising a dovetail inside the socket for facilitating aligning the plurality of conductive terminals with the solder bumps.

15. The socket of claim 11, further comprising elastic means joined to each of the solder bumps for performing a good electrical connection with the conductive terminals.

16. The socket of claim 14, further comprising a transparent mask mounted on the body, and a slot located on the top surface of the mask for receiving the readable disk.

17. The socket of claim 16, wherein said mask and body are integrated into one single piece.

18. The socket of claim 16, further comprising a perfume box placed on the surfaces of the mask.

19. The socket of claim 16, wherein a clock control box is placed on a first surface of the mask and a LCD panel for showing the current time is placed on a second surface of the mask.

* * * * *